US010826178B2

(12) United States Patent
Liao et al.

(10) Patent No.: US 10,826,178 B2
(45) Date of Patent: Nov. 3, 2020

(54) MULTI-BAND ANTENNA

(71) Applicants: Wen-Jiao Liao, Taipei (TW); Hao-Ju Hsieh, Taipei (TW); Yen-Hao Yu, Taipei (TW); Shih-Chia Liu, Taipei (TW); Liang-Che Chou, Taipei (TW); Li-Chun Lee, Taipei (TW)

(72) Inventors: Wen-Jiao Liao, Taipei (TW); Hao-Ju Hsieh, Taipei (TW); Yen-Hao Yu, Taipei (TW); Shih-Chia Liu, Taipei (TW); Liang-Che Chou, Taipei (TW); Li-Chun Lee, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 16/026,075

(22) Filed: Jul. 3, 2018

(65) Prior Publication Data

US 2019/0006755 A1 Jan. 3, 2019

Related U.S. Application Data

(60) Provisional application No. 62/528,419, filed on Jul. 3, 2017.

(51) Int. Cl.
*H01Q 5/30* (2015.01)
*H01Q 5/335* (2015.01)
(Continued)

(52) U.S. Cl.
CPC ..... *H01Q 5/335* (2015.01); *H01Q 1/36* (2013.01); *H01Q 1/38* (2013.01); *H01Q 5/342* (2015.01);
(Continued)

(58) Field of Classification Search
CPC .. H01Q 1/38; H01Q 5/30–5/392; H01Q 13/10
(Continued)

(56) References Cited

U.S. PATENT DOCUMENTS 7,079,079 B2 * 7/2006 Jo ..... H01Q 1/243 343/700 MS
7,548,214 B2 * 6/2009 Chou ..... H01Q 1/38 343/700 MS
(Continued)

FOREIGN PATENT DOCUMENTS

TW 200522440 7/2005
TW 200835055 8/2008

OTHER PUBLICATIONS

"Office Action of Taiwan Counterpart Application", dated May 31, 2019, pp. 1-5.

*Primary Examiner* — Dameon E Levi
*Assistant Examiner* — Hasan Z Islam
(74) *Attorney, Agent, or Firm* — JCIPRNET

(57) ABSTRACT

A multi-band antenna including a ground portion, a first radiation portion, a second radiation portion, a feeding portion and a matching portion is provided. The first radiation portion is disposed beside the ground portion, a first gap is existed between the ground portion and the first radiation portion so as to form a first slot, and the first slot has a first open terminal located at the first gap. The second radiation portion is connected to the first radiation portion. The feeding portion is located between the first radiation portion and the second radiation portion. The matching portion is located in the first slot and connected to the first radiation portion and the ground portion. The feeding portion excites the first slot to generate a first resonant mode. The second radiation portion generates a second resonant mode.

13 Claims, 8 Drawing Sheets

(51) Int. Cl.

| | |
|---|---|
| ***H01Q 13/10*** | (2006.01) |
| ***H01Q 9/30*** | (2006.01) |
| ***H01Q 1/36*** | (2006.01) |
| ***H01Q 21/06*** | (2006.01) |
| ***H01Q 5/342*** | (2015.01) |
| ***H01Q 1/38*** | (2006.01) |

(52) U.S. Cl.
CPC ..... *H01Q 9/30* (2013.01); *H01Q 13/10* (2013.01); *H01Q 21/064* (2013.01)

(58) Field of Classification Search
USPC ..... 343/700 MS
See application file for complete search history.

(56) References Cited

U.S. PATENT DOCUMENTS

| | | | | |
|---|---|---|---|---|
| 8,368,602 | B2 * | 2/2013 | Hill | H01Q 9/285 343/702 |
| 2004/0008146 | A1 * | 1/2004 | Ikegaya | H01Q 1/22 343/767 |
| 2010/0238072 | A1 * | 9/2010 | Ayatollahi | H01Q 1/243 343/700 MS |
| 2018/0261921 | A1 * | 9/2018 | Ha | H01Q 1/243 |

* cited by examiner

MULTI-BAND ANTENNA

CROSS-REFERENCE TO RELATED APPLICATION

This application claims the priority benefit of U.S. provisional application Ser. No. 62/528,419, filed on Jul. 3, 2017. The entirety of the above-mentioned patent application is hereby incorporated by reference herein and made a part of this specification.

BACKGROUND OF THE INVENTION

Field of the Invention

The invention relates to an antenna, and particularly relates to a multi-band antenna applied to communication products.

Description of Related Art

Along with development of communication technology, increasing use of communication technology in technology products has led to diversification of related communication products, and electronic devices having a wireless transmission function have become indispensable products in daily life. In recent years, consumers not only have higher requirements on functions of the communication products, but also focus on design requirements of narrow border and large screen for the appearance of the communication products, so that many narrow border screen communication products with different designs and different functions are constantly proposed. In the communication products, a main function of an antenna is to transmit and receive signals, and how to make the antenna to have a small size and adapted to transmit multi-band signals is a popular trend in recent years.

SUMMARY OF THE INVENTION

The invention is directed to a multi-band antenna, which is adapted to provide good multi-band wireless transmission.

The invention provides a multi-band antenna including a ground portion, a first radiation portion, a second radiation portion, a feeding portion and a matching portion. The first radiation portion is disposed beside the ground portion, where a first gap is existed between the ground portion and the first radiation portion so as to form a first slot, and the first slot has a first open terminal located at the first gap. The second radiation portion is connected to the first radiation portion. The feeding portion is located between the first radiation portion and the second radiation portion. The matching portion is located in the first slot and connected to the first radiation portion and the ground portion. The feeding portion excites the first slot to generate a first resonant mode. The second radiation portion generates a second resonant mode.

In an embodiment of the invention, the matching portion is disposed in the first slot and close to the feeding portion.

In an embodiment of the invention, the matching portion is a conductor with a smallest width less than 2 mm or an inductor.

In an embodiment of the invention, a resonant length of the first resonant mode from the feeding portion to the first open terminal is 0.2-0.3 wavelength.

In an embodiment of the invention, a resonant length of the second radiation portion is 0.2-0.3 wavelength of the second resonant mode.

In an embodiment of the invention, a shape of the first slot is a "-" shape or an L-shape.

In an embodiment of the invention, the multi-band antenna further includes a third radiation portion spaced by a second gap from the second radiation portion, and the third radiation portion being coupled by the second radiation portion to generate a third resonant mode.

In an embodiment of the invention, a resonant length of the third resonant mode from the feeding portion coupling to the third radiation portion through the second radiation portion is 0.6-0.8 wavelength.

In an embodiment of the invention, the third radiation portion is connected to the ground portion at one end away from the second radiation portion, and a resonant length of the third radiation portion is 0.2-0.3 wavelength of the third resonant mode.

In an embodiment of the invention, the multi-band antenna further includes a third radiation portion and a fourth radiation portion. The third radiation portion and the second radiation portion are spaced by a second gap, and the second gap has a second open terminal. The fourth radiation portion and the third radiation portion are spaced by a third gap, and the third gap has a third open terminal, and the fourth radiation portion is connected to the ground portion at one end away from the third radiation portion, where the feeding portion, the second radiation portion, the third radiation portion, the fourth radiation portion and the ground portion are surrounding to form a second slot to generate a third resonant mode.

In an embodiment of the invention, a resonant length of the third resonant mode from the feeding portion to the third open terminal is 0.4-0.6 wavelength.

In an embodiment of the invention, the multi-band antenna is formed on a substrate.

According to the above description, in the multi-band antenna of the invention, based on the design of connecting the matching portion to the first radiation portion and the ground portion, an inductive conductor or an inductive element is adopted to mitigate an influence of impedance mismatch, such that the multi-band antenna has better impedance matching, and the feeding portion to the first open terminal generates the first resonant mode, and the second radiation portion generates the second resonant mode.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
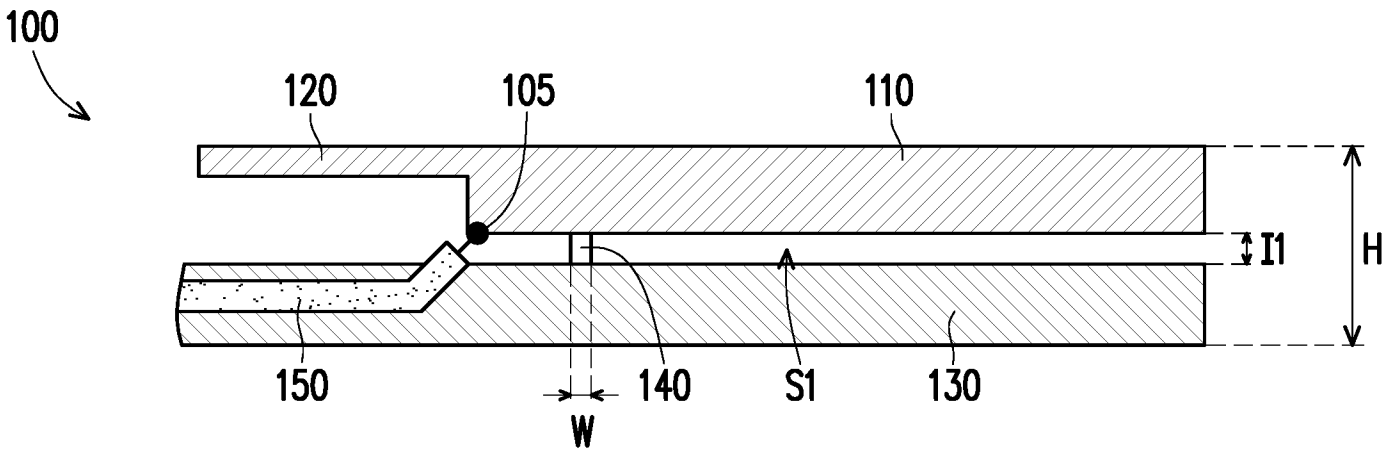
FIG. 1 is a schematic diagram of a multi-band antenna according to an embodiment of the invention.
Figure 2:
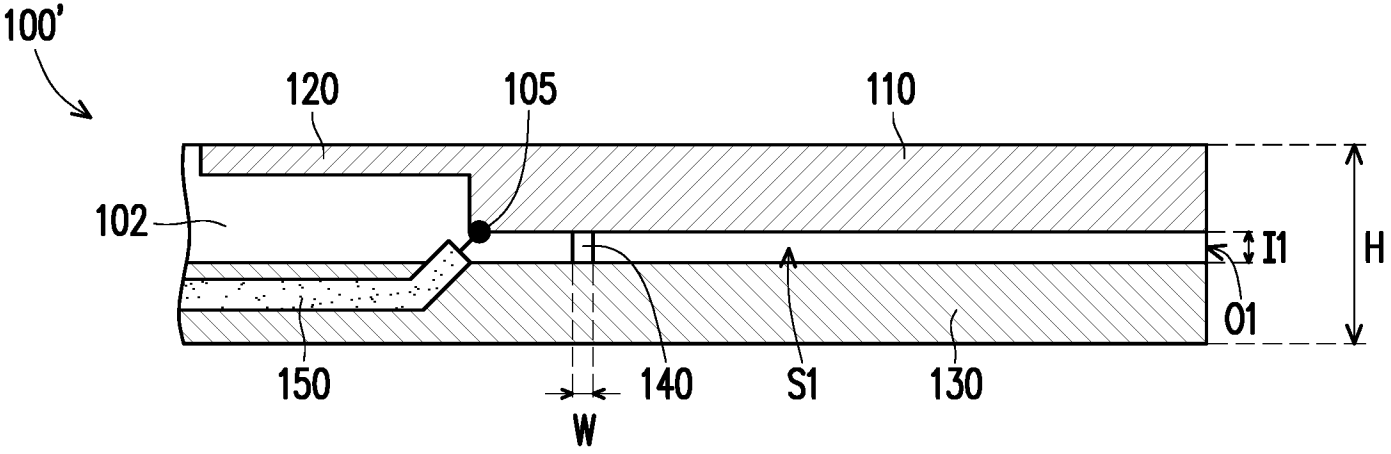
FIG. 2 is a schematic diagram of a multi-band antenna according to another embodiment of the invention.

FIG. 1 is a schematic diagram of a multi-band antenna according to an embodiment of the invention. FIG. 2 is a schematic diagram of a multi-band antenna according to another embodiment of the invention. Referring to FIG. 1, the multi-band antenna 100 of the embodiment includes a ground portion 130, a first radiation portion 110, a second radiation portion 120, a feeding portion 105 and a matching portion 140. In the embodiment, the ground portion 130, the first radiation portion 110 and the second radiation portion 120 are conductors, for example, metal. In the embodiment, the matching portion 140 is, for example, a conductor with a smallest width less than 2 mm, though in other embodiments, the matching portion 140 may also be an inductor. In the embodiment, the multi-band antenna 100 may be formed through metal wire cutting, though the invention is not limited thereto. In other embodiment, as shown in FIG. 2, the multi-band antenna 100' may be formed on a substrate 102, and the substrate 102 may be a printed circuit board or a plastic holder, though the type of the substrate 102 is not limited thereto.

Referring to FIG. 2, the ground portion 130 and the first radiation portion 110 are disposed on the substrate 102, and the first radiation portion 110 is disposed beside the ground portion 130, where a first gap I1 is existed between the ground portion 130 and the first radiation portion 110 so as to form a first slot S1. In the embodiment, the first slot S1 has a "-" shape, though the invention is not limited thereto. Moreover, the second radiation portion 120 is disposed on the substrate 102 and connected to the first radiation portion 110.

In the embodiment, the feeding portion 105 is located between the first radiation portion 110 and the second radiation portion 120, and a coaxial cable 150 is connected between the feeding portion 105 and the ground portion 130.

The matching portion 140 is located in the first slot S1 and connected to the first radiation portion 110 and the ground portion 130. In the embodiment, the matching portion 140 is disposed in the first slot S1 and close to the feeding portion 105. In the multi-band antenna 100' of the embodiment, based on the design of connecting the matching portion 140 to the first radiation portion 110 and the ground portion 130, an inductive conductor or an inductive element is adopted to mitigate the influence of impedance mismatch, such that the multi-band antenna 100' has better impedance matching. In the embodiment, a width W of the matching portion 140 along an extending direction thereof may be the same or different, though the smallest width is required to be less than 2 mm.

It should be noted that in the embodiment, the first slot S1 has a first open terminal O1 at one end away from the feeding portion 105, and the first open terminal O1 is located at the first gap I1. The feeding portion 105 excites the first slot S1 to generate a first resonant mode, and a resonant length of the first resonant mode is 0.2-0.3 wavelength. Moreover, in the embodiment, the second radiation portion 120 generates a second resonant mode, and a resonant length of the second radiation portion 120 is 0.2-0.3 wavelength.

Figure 3:
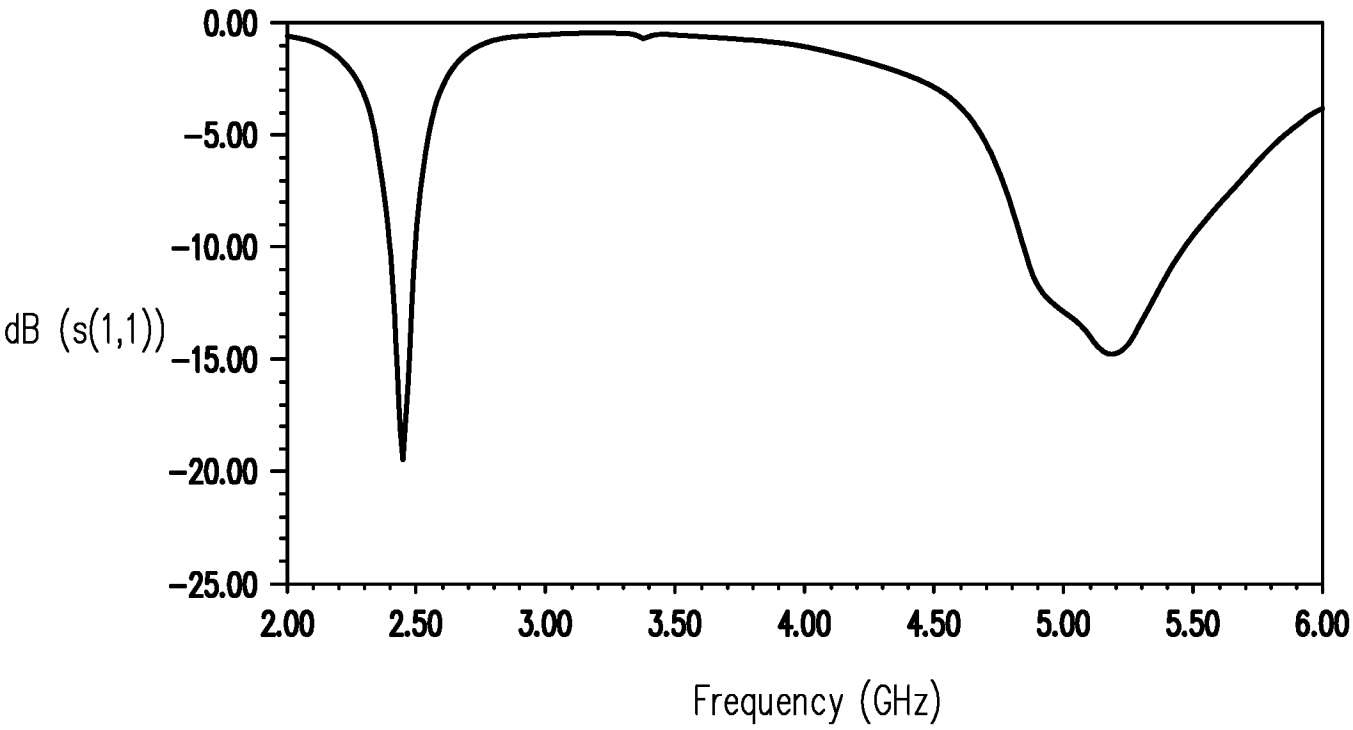
FIG. 3 is a schematic diagram of a resonant mode of the multi-band antenna of FIG. 2.

FIG. 3 is a schematic diagram of a resonant mode of the multi-band antenna 100' of FIG. 2. Referring to FIG. 3, in the embodiment, the multi-band antenna 100' may have good first resonant mode and second resonant mode to provide a multi-band function. The first resonant mode is, for example, a 2.4 GHz frequency band (about between 2.4 GHz to 2.5 GHz), and the second resonant mode is, for example, a 5 GHz frequency band (about between 4.8 GHz to 5.5 GHz), certainly, a frequency band range of the first resonant mode and the second resonant mode is not limited thereto.

Generally, an antenna of a mobile communication device is configured at a border, and if the mobile communication device is to provide a large screen under limited body size, a narrow border design is generally adopted, though the narrow border design may constrict a space of the antenna, such that a capacitive reactance of the small size antenna is increased to result in impedance mismatch to affect design difficulty of the antenna. The multi-band antenna 100' of the embodiment has the design of the matching portion 140, and by using the inductive conductor or inductive element to mitigate the influence of impedance mismatch, the multi-band antenna 100' may be applied to the mobile communication device with a narrow border, and provide a good multi-band wireless transmission function. In an embodiment, a height H of the multi-band antenna 100' may be reduced to about 4 mm to achieve a rather small height.

The multi-band antennas of other implementations are introduced below. It should be noted that in the following embodiment, components that are the same or similar with that of the aforementioned embodiment are denoted by the same or similar referential numbers, and details thereof are not repeated, and only main differences are introduced.

Figure 4:
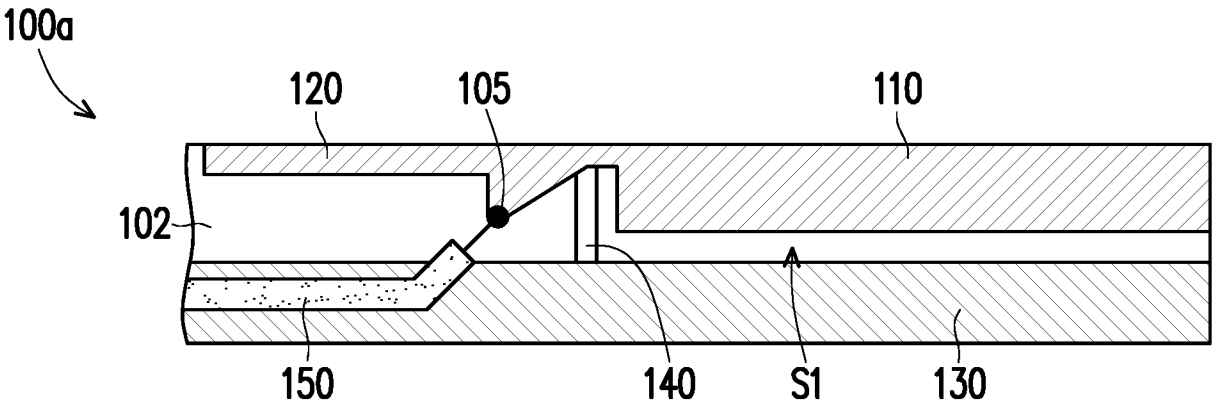
FIG. 4 is a schematic diagram of a multi-band antenna according to another embodiment of the invention.

FIG. 4 is a schematic diagram of a multi-band antenna according to another embodiment of the invention. Referring to FIG. 4, a main difference between the multi-band antenna 100*a* of FIG. 4 and the multi-band antenna 100' of FIG. 2 is that the first slot S1 has a different shape. In the embodiment, the shape of the first slot S1 is close to an L-shape, and the first slot S1 has different width along the extending direction thereof.

Figure 5:
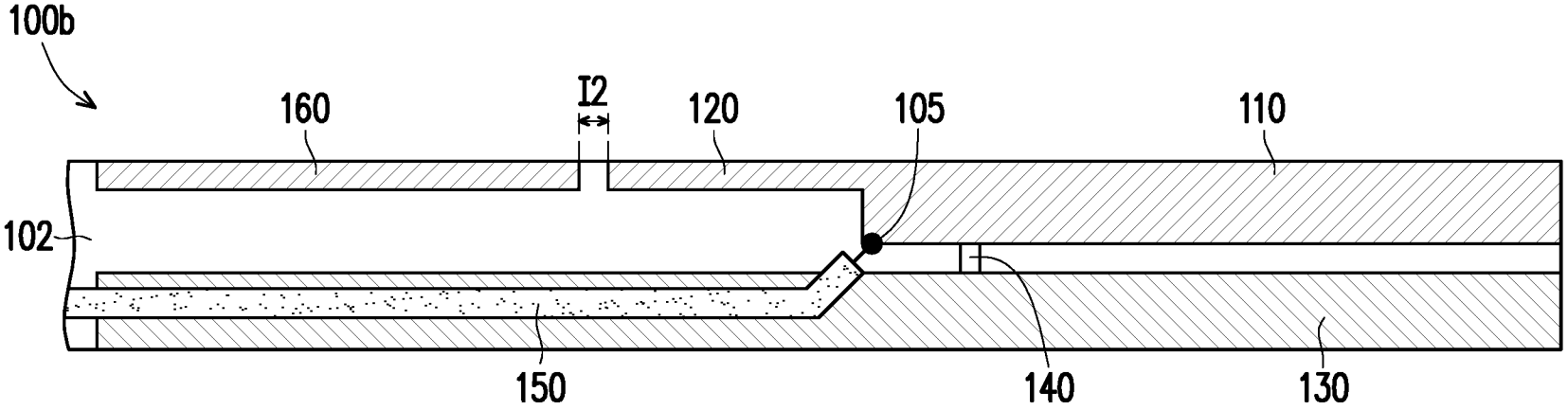
FIG. 5 is a schematic diagram of a multi-band antenna according to another embodiment of the invention.

FIG. 5 is a schematic diagram of a multi-band antenna according to another embodiment of the invention. Referring to FIG. 5, a main difference between the multi-band antenna 100*b* of FIG. 5 and the multi-band antenna 100' of FIG. 2 is that in the embodiment, the multi-band antenna 100*b* further includes a third radiation portion 160 disposed on the substrate 102 and spaced by a second gap I2 from the second radiation portion 120, where the second gap I2 is, for example, smaller than 3 mm.

In the embodiment, the third radiation portion 160 is coupled by the second radiation portion 120 to generate a third resonant mode, and a resonant length of the third resonate mode from the feeding portion 105 through the second radiation portion 120 is 0.6-0.8 wavelength. In this way, in the embodiment, besides that the multi-band antenna 100*b* generates the first resonant mode excited by the feeding portion 105 to the first open terminal O1, and the second radiation portion 120 generates the second resonant mode, the multi-band antenna 100*b* further generates the third resonant mode through the second radiation portion 120 coupling to the third radiation portion 160.

Figure 6:
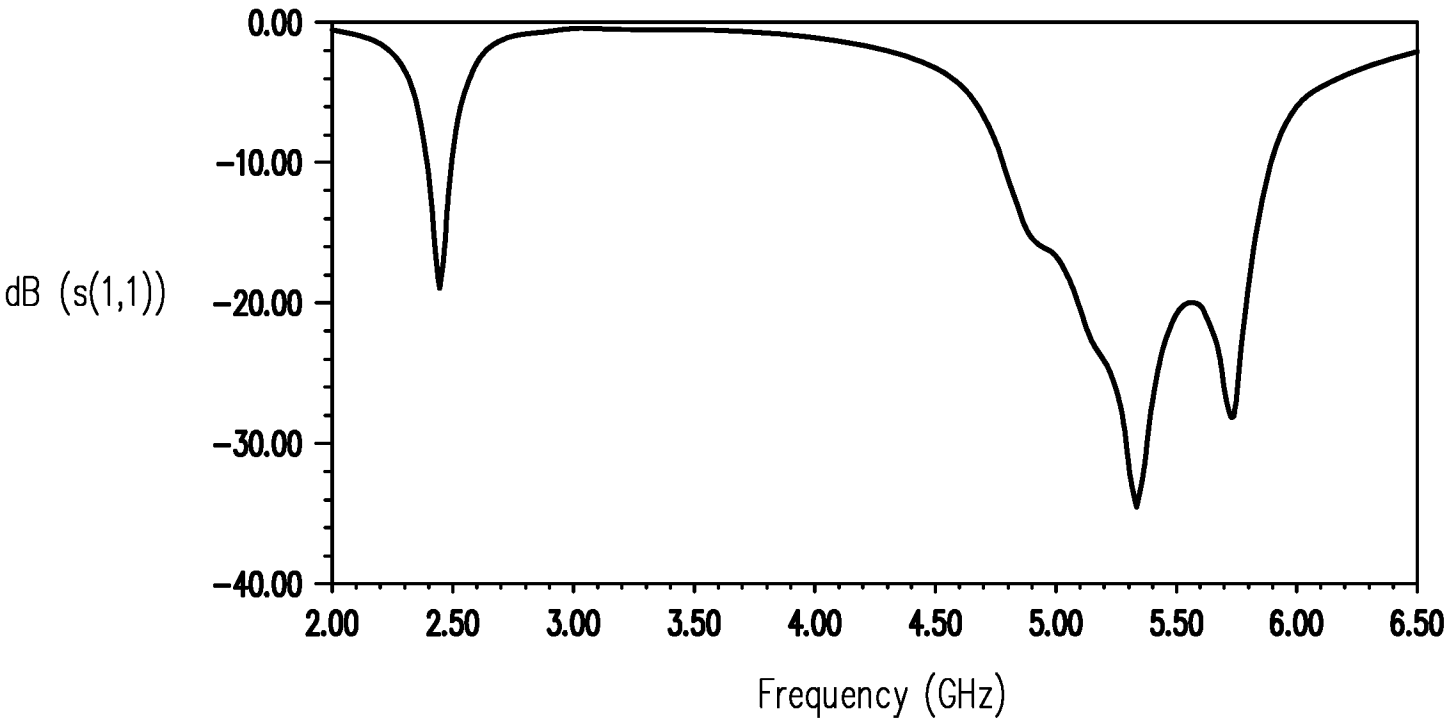
FIG. 6 is a schematic diagram of a resonant mode of the multi-band antenna of FIG. 5.

FIG. 6 is a schematic diagram of a resonant mode of the multi-band antenna of FIG. 5. Referring to FIG. 6, the multi-band antenna 100*b* of the embodiment may have the first resonant mode, the second resonant mode and the third resonant mode. The first resonant mode is, for example, a 2.4 GHz frequency band (about between 2.4 GHz to 2.5 GHz), the second resonant mode and the third resonant mode are combined to form a broadband mode, which is, for example, a 5 GHz frequency band (about between 4.8 GHz to 5.9 GHz) to provide multi-band mode. Certainly, a frequency band range of the first resonant mode, the second resonant mode and the third resonant mode is not limited thereto.

Figure 7:
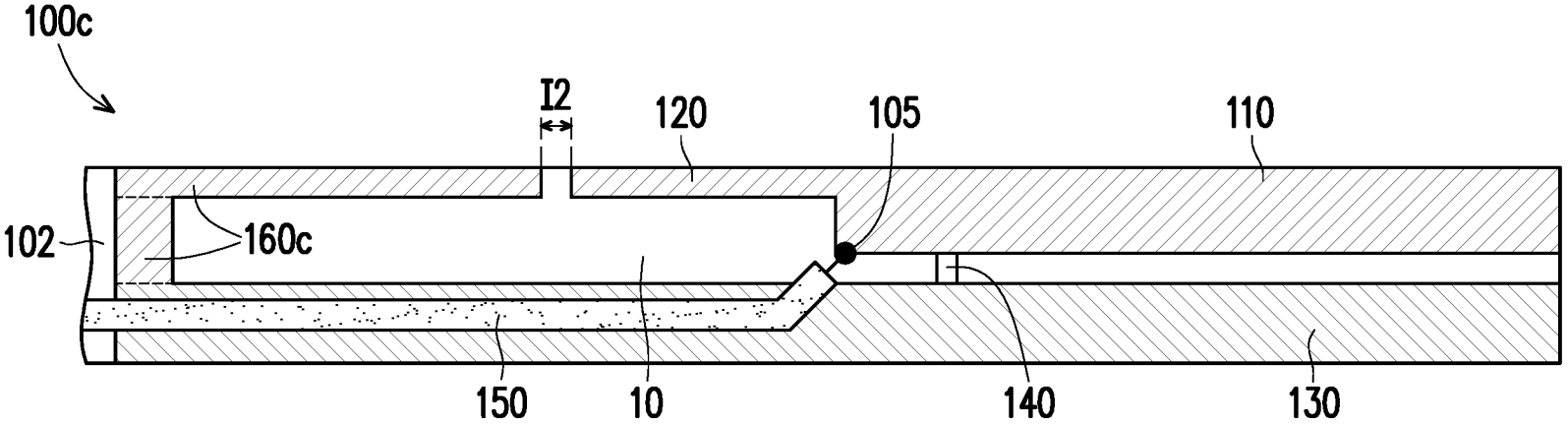
FIG. 7 is a schematic diagram of a multi-band antenna according to another embodiment of the invention.

FIG. 7 is a schematic diagram of a multi-band antenna according to another embodiment of the invention. Referring to FIG. 7, a main difference between the multi-band antenna 100*c* of FIG. 7 and the multi-band antenna 100*b* of FIG. 5 is that in the embodiment, the third radiation portion 160*c* is connected to the ground portion 130 at an end away from the second radiation portion 120. Namely, in the embodiment, the third radiation portion 160*c* presents an inverted L-shape.

In the embodiment, a resonant length of the third radiation portion 160*c* is 0.2-0.3 wavelength of the third resonant mode. In the embodiment, the multi-band antenna 100*c* generates the first resonant mode excited by the feeding portion 105 to the first open terminal O1, the second radiation portion 120 generates the second resonant mode, and the third radiation portion 160*c* is coupled by the second radiation portion 120 to generate the third resonant mode, so as to provide the multi-band function.

Figure 8:
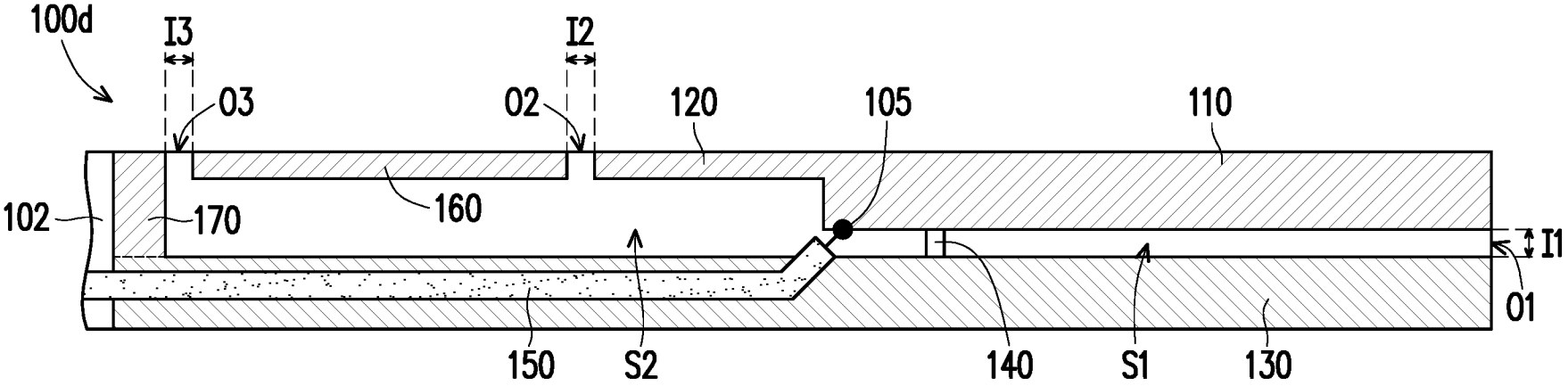
FIG. 8 is a schematic diagram of a multi-band antenna according to another embodiment of the invention.

FIG. 8 is a schematic diagram of a multi-band antenna according to another embodiment of the invention. Referring to FIG. 8, a main difference between the multi-band antenna 100*d* of FIG. 8 and the multi-band antenna 100*b* of FIG. 5 is that in the embodiment, the multi-band antenna 100*d* further includes a fourth radiation portion 170. The fourth radiation portion 170 is disposed on the substrate 102 and spaced by a third gap I3 with the third radiation portion 160, where the third gap I3 is smaller than 3 mm. In the embodiment, an extending direction of the fourth radiation portion 170 is perpendicular to an extending direction of the third radiation portion 160, and the fourth radiation portion 170 is connected to the ground portion 130 at one end away from the third radiation portion 160.

According to FIG. 8, it is known that in the embodiment, the feeding portion 105, the second radiation portion 120, the third radiation portion 160, the fourth radiation portion 170 and the ground portion 130 are surrounding to form a second slot S2, and the second gap I2 has a second open terminal O2 between the second radiation portion 120 and the third radiation portion 160, and the third gap I3 has a third open terminal O3 between the third radiation portion 160 and the fourth radiation portion 170.

In the embodiment, a resonant length of the third resonate mode from the feeding portion 105 to the third open terminal O3 is 0.4-0.6 wavelength. The multi-band antenna 100*d* generates the first resonant mode through the feeding portion 105 to the first open terminal O1, the second radiation portion 120 generates the second resonant mode, and the feeding portion 105, the second radiation portion 120, the third radiation portion 160, the fourth radiation portion 170 and the ground portion 130 generate the third resonant mode to provide the multi-band function.

In summary, in the multi-band antenna of the invention, based on the design of connecting the matching portion to the first radiation portion and the ground portion, an inductive conductor or an inductive element is adopted to mitigate an influence of impedance mismatch, such that the multi-band antenna has better impedance matching, and the feeding portion to the first open terminal generates the first resonant mode, and the second radiation portion generates the second resonant mode, or the third radiation portion (or the third radiation portion and the fourth radiation portion) may be adopted to generate the third resonant mode to provide the multi-band function. Moreover, the multi-band antenna of the invention may have a smaller height, which belongs to a low profile antenna, and is adapted to be applied to narrow-border mobile communication devices to satisfy the requirements of good multi-band wireless transmission.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A multi-band antenna, comprising:

a ground portion;

a first radiation portion, disposed beside the ground portion, wherein a first gap exists between the ground portion and the first radiation portion so as to form a first slot having a "-" shape or an L-shape, wherein the first slot has as a first open terminal located at the first gap;

a second radiation portion, connected to the first radiation portion;

a feeding portion, located between the first radiation portion and the second radiation portion; and a matching element, located in the first slot and connected to the first radiation portion and the ground portion, wherein the feeding portion excites the first slot to generate a first resonant mode, and the second radiation portion generates a second resonant mode of the multi-band antenna.

2. The multi-band antenna as claimed in claim 1, wherein the matching element is disposed in the first slot and close to the feeding portion.

3. The multi-band antenna as claimed in claim 1, wherein the matching element is a conductor with a smallest width less than 2 mm or an inductor.

4. The multi-band antenna as claimed in claim 1, wherein a resonant length of the first resonant mode from the feeding portion to the first open terminal is 0.2-0.3 wavelength.

5. The multi-band antenna as claimed in claim 1, wherein a resonant length of the second radiation portion is 0.2-0.3 wavelength of the second resonant mode.

6. The multi-band antenna as claimed in claim 1, further comprising:

a third radiation portion, spaced by a second gap from the second radiation portion, and the third radiation portion being coupled by the second radiation portion to generate a third resonant mode.

7. The multi-band antenna as claimed in claim 6, wherein a resonant length of the third resonant mode from the feeding portion coupling to the third radiation portion through the second radiation portion is 0.6-0.8 wavelength.

8. The multi-band antenna as claimed in claim 6, wherein the third radiation portion is connected to the ground portion at one end away from the second radiation portion, and a resonant length of the third radiation portion is 0.2-0.3 wavelength of the third resonant mode.

9. The multi-band antenna as claimed in claim 1, further comprising:

a third radiation portion, wherein the third radiation portion and the second radiation portion are spaced by a second gap, and the second gap has a second open terminal;

a fourth radiation portion, wherein the fourth radiation portion and the third radiation portion are spaced by a third gap, the third gap has a third open terminal, and the fourth radiation portion is connected to the ground portion at one end away from the third radiation portion, wherein the feeding portion, the second radiation portion, the third radiation portion, the fourth radiation portion and the ground portion are surrounding to form a second slot to generate a third resonant mode.

10. The multi-band antenna as claimed in claim 9, wherein a resonant length of the third resonant mode from the feeding portion to the third open terminal is 0.4-0.6 wavelength.

11. The multi-band antenna as claimed in claim 1, wherein the multi-band antenna is formed on a substrate.

12. The multi-band antenna as claimed in claim 6, wherein the multi-band antenna is formed on a substrate.

13. The multi-band antenna as claimed in claim 9, wherein the multi-band antenna is formed on a substrate.

* * * * *